US009261854B2

(12) United States Patent
Kitan

(10) Patent No.: US 9,261,854 B2
(45) Date of Patent: Feb. 16, 2016

(54) FRAME OF APPARATUS AND IMAGE FORMING APPARATUS

(71) Applicant: CANON KABUSHIKI KAISHA, Tokyo (JP)

(72) Inventor: Tomonori Kitan, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/467,249

(22) Filed: Aug. 25, 2014

(65) Prior Publication Data

US 2015/0063864 A1 Mar. 5, 2015

(30) Foreign Application Priority Data

Sep. 3, 2013 (JP) ..... 2013-182007

(51) Int. Cl.
*G03G 15/00* (2006.01)
*G03G 21/16* (2006.01)

(52) U.S. Cl.
CPC ..... *G03G 21/1619* (2013.01)

(58) Field of Classification Search
CPC ..... G03G 15/0812; G03G 21/1619; G03G 15/80; G03G 21/1647; G03G 15/043; G03G 15/0865; G03G 15/0891; G03G 15/6529; G03G 15/757; G03G 21/1671; G03G 21/1676; G03G 5/065; G03G 5/0651; G03G 15/0131; G03G 2215/0043; G03G 2215/00556; G03G 2215/00675; G03G 2215/00679; G03G 2215/00945; G03G 2215/2035; G03G 2221/1853
See application file for complete search history.

(56) References Cited

U.S. PATENT DOCUMENTS

| | | | | |
|---|---|---|---|---|
| 4,996,563 | A * | 2/1991 | Blanding | 399/165 |
| 2006/0158728 | A1* | 7/2006 | Masaki et al. | 359/460 |
| 2010/0019443 | A1* | 1/2010 | Ichikawa | 271/241 |

FOREIGN PATENT DOCUMENTS

JP 2000-330351 A 11/2000

* cited by examiner

*Primary Examiner* — Roy Y Yi
(74) *Attorney, Agent, or Firm* — Fitzpatrick, Cella, Harper & Scinto

(57) ABSTRACT

A frame of an apparatus includes first and second skeleton frames arranged to face each other and third and fourth skeleton frames configured to couple the first and second skeleton frames. A first installation portion is provided on the third skeleton frame at a position closer to the second skeleton frame side than a center portion of the third skeleton frame. Second and third installation portions are provided on the fourth skeleton frame. A coupling stay includes a first end portion fixed to the third skeleton frame at a position closer to one skeleton frame out of the first and second skeleton frames than the center of the third skeleton frame and a second end portion fixed to the other skeleton frame out of the first and second skeleton frames at a position closer to the fourth skeleton frame side than the third skeleton frame.

26 Claims, 11 Drawing Sheets

FRAME OF APPARATUS AND IMAGE FORMING APPARATUS

BACKGROUND OF THE INVENTION

1. Field of the Invention

The present invention relates to a frame of an apparatus such as an image forming apparatus such as a copying machine, a printer, and a facsimile, and a multifunction machine having a plurality of functions thereof and an image forming apparatus including the frame.

2. Description of the Related Art

In image formation of an image forming apparatus, such as a full color printer that employs an electrographic scheme, the deflection or the twist of a frame that forms a skeleton structure of an apparatus influences the image quality or the like in some cases. A configuration known in the past to suppress the deflection or the twist of the frame includes increasing the stiffness by causing a cross-sectional area of the frame to be large. In addition, as described in JP-A-2000-330351, a configuration of providing three installation portions for installing the apparatus on the installation surface has been known in the past. In this manner, since three installation portions are provided in this manner, even if there is unevenness on the installation surface of the apparatus, respective installation portions are more securely in contact with the installation surface. Therefore, the frame is rarely twisted.

However, if the cross-sectional area of the configuration member of the frame is caused to be large in order to suppress the twist or the like of the frame as discussed above, the weight or the component cost of the apparatus increases. Meanwhile, if three installation portions are provided, the twist or the like of the frame may easily occur because of the arrangement of the three of grounding portions.

SUMMARY OF THE INVENTION

According to an aspect of the present invention, there is provided a frame of an apparatus including a first skeleton frame, a second skeleton frame arranged to face the first skeleton frame, a third skeleton frame configured to couple the first skeleton frame and the second skeleton frame on one end side, a fourth skeleton frame configured to couple the first skeleton frame and the second skeleton frame on the other end side, a first installation portion provided on the third skeleton frame at a position closer to the second skeleton frame side than a center portion of the third skeleton frame, and configured to be in contact with an installation surface of the apparatus, a second installation portion provided on the fourth skeleton frame and configured to be in contact with the installation surface of the apparatus, a third installation portion provided on the fourth skeleton frame at a position having a distance equal to or greater than a half length of the fourth skeleton frame from the second installation portion and configured to perform substantially three point supporting on the frame together with the first and second installation portions, and a coupling stay configured to couple the third skeleton frame and the second skeleton frame. The coupling stay includes a first end portion fixed to the third skeleton frame at a position closer to one skeleton frame out of the first and second skeleton frames than the center of the third skeleton frame, and a second end portion fixed to the other skeleton frame out of the first and second skeleton frames at a position closer to the fourth skeleton frame side than the third skeleton frame.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

First Embodiment

Figure 1:
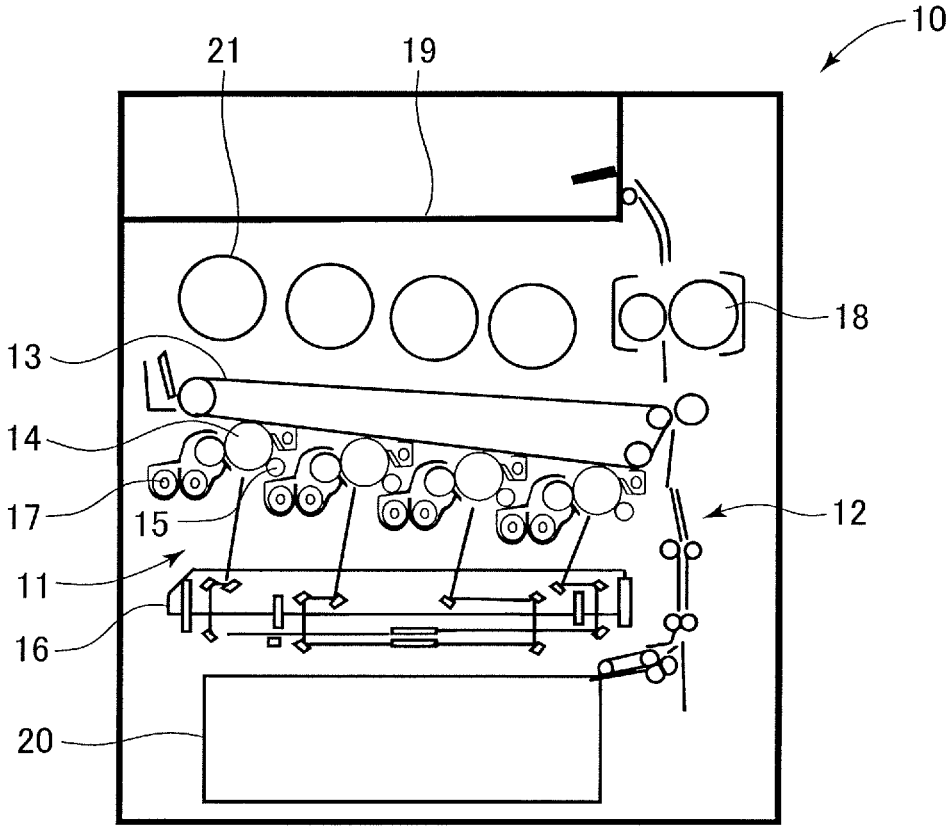
FIG. 1 is a section view schematically illustrating a configuration of an image forming apparatus including a frame according to a first embodiment.

A first embodiment of the present invention is described with reference to FIGS. 1 to 10. First, a schematic configuration of an image forming apparatus 10 of the present embodiment is described with reference to FIG. 1.

<Image Forming Apparatus>

The image forming apparatus 10 according to the present embodiment is a full color printer to which an electrographic scheme is applied. The image forming apparatus 10 includes an image forming portion 11 that forms a toner image and a recording medium conveyance portion 12 that conveys a recording medium to record the toner image formed by the image forming portion 11 (a sheet material such as sheet or OHP sheet). The image forming portion 11 has a so-called tandem configuration in which a plurality of image forming stations are arranged in a traveling direction of an intermediate transfer belt 13. Toner images of yellow, magenta, cyan, and black are formed in the respective image forming stations.

The toner images are formed in the respective image forming stations as follows. First, electrostatic latent images are formed by charging surfaces of photoconductive drums 14 by charging rollers 15, and exposing the charged surfaces of the photoconductive drums 14 to laser or the like by an exposure unit 16 according to the image information. Next, the toner images are formed on the surfaces of the photoconductive drums 14 by developing the electrostatic latent images with toner by developing units 17. The toner images formed on the surfaces of the photoconductive drums 14 of the respective image forming stations are transferred to the intermediate transfer belt 13 in sequence and in an overlapped manner, so that the full color toner images are formed on the intermediate transfer belt 13. The toner images on the intermediate transfer belt 13 are transferred to the recording medium conveyed by the recording medium conveyance portion 12. The recording medium to which the toner images are transferred is heated and pressed by a fixing unit 18 so that the toner images are fixed. The recording medium on which the toner images are fixed is discharged to a discharge tray 19.

Further, in the example of FIG. 1, the discharge tray 19 is provided on the upper side of the image forming portion 11. Though it is not illustrated in FIG. 1, a document reading apparatus 22 (see FIG. 4 described below) that reads the document is provided on the upper portion of the image forming apparatus 10, and the discharge tray 19 is provided in a space between the document reading apparatus and the image forming portion 11.

The recording medium conveyance portion 12 is configured with a plurality of conveying rollers, picks up the recording medium stored in a cassette 20, and conveys the recording medium to the image forming portion 11. In the example of FIG. 1, the recording medium is conveyed from the cassette 20 provided on the lower portion of the main body of the apparatus toward the upper portion of the main body of the apparatus. Therefore, the recording medium conveyance portion 12 is arranged in the substantially vertical direction on one side (the right side seen from the front surface of the apparatus) of the main body of the apparatus.

First, in the image forming apparatus 10, respective color toner bottles 21 that supply toner to the developing units 17 are arranged to be freely inserted. The toner bottles 21 can be inserted into or extracted from the main body of the apparatus by opening a door (not illustrated) on the front surface of the apparatus. Further, an operating panel for operating the image forming apparatus 10 by a user is provided on the front surface side of the apparatus. That is, user interfaces such as an opening and closing door or an operating panel for exchanging the toner bottles 21 are provided on the front surface side of the apparatus.

<Frame>

Figure 2:
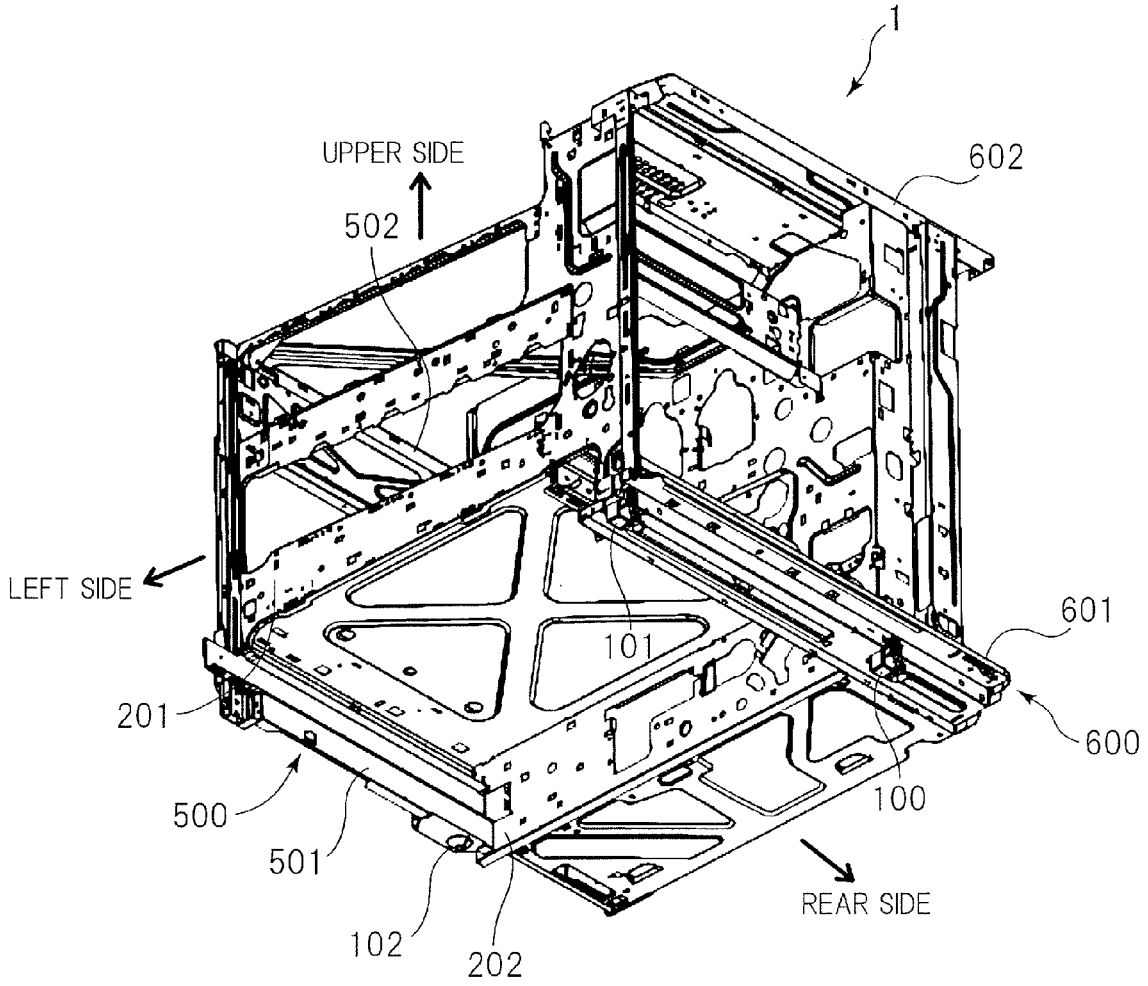
FIG. 2 is a perspective view illustrating the frame of the apparatus according to the first embodiment seen from below on the front surface side.
Figure 3:
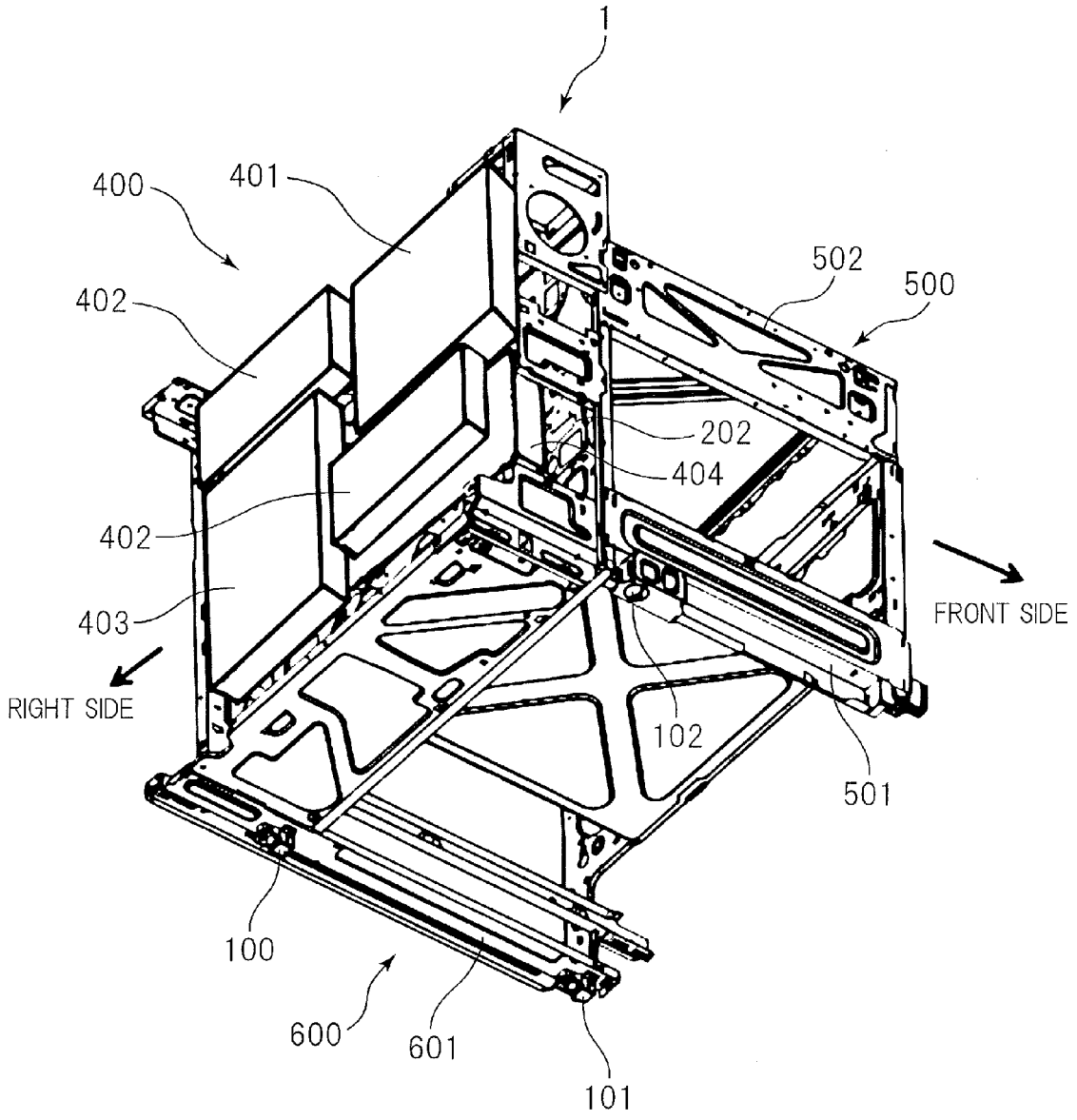
FIG. 3 is a perspective view illustrating the frame seen from below on the rear surface side in a state where an electric unit is arranged on the frame according to the first embodiment.

Next, a frame 1 of the image forming apparatus 10 is described below using FIGS. 2 to 10. FIG. 2 is a perspective view illustrating a frame of the apparatus according to the first embodiment seen from below on the front surface side. FIG. 3 is a perspective view illustrating the frame seen from below on the rear surface side in a state where electric units are arranged on the frame according to the first embodiment. The frame 1 includes a front side plate 201 and a rear side plate 202 which are a pair of skeleton frames arranged to face each other as illustrated in FIGS. 2 and 3, a left stay 500 (first stay) and a right stay 600 (second stay), which are a third skeleton frame and a fourth skeleton frame respectively, and an oblique stay 700 (FIG. 5) which is a coupling stay. The front side plate 201 is a plate-shaped side plate arranged on the front surface side of the apparatus and composes a first skeleton frame. The rear side plate 202 is a plate-shaped side plate arranged on the rear surface side of the apparatus and composes a second skeleton frame. The left stay 500 and the right stay 600 are arranged on both sides of the front side plate 201 and the rear side plate 202, and couple the front side plate 201 and the rear side plate 202. Specifically, the left stay 500 composes a third skeleton frame coupling the first skeleton frame and the second skeleton frame on one end (first end) side. Also, the right stay 600 composes a fourth skeleton frame coupling the first skeleton frame and the second skeleton frame on the other end (second end) side. That is, the left stay 500 couples the one end side of the first skeleton frame and the one end side of the second skeleton frame. The right stay 600 couples the other end side of the first skeleton frame and the other end side of the second skeleton frame. Accordingly, the left stay 500 and the right stay 600 are arranged to face each other so that the left stay 500 is arranged on the left side of the front side plate 201, and the right stay 600 is arranged on the right side of the front side plate 201. The oblique stay 700 is described below.

The left stay 500 which is the first stay includes a lower left stay 501 which is a lower stay arranged on the lower side of the apparatus and an upper left stay 502 which is an upper stay arranged on the upper side of the apparatus. The right stay 600 which is the second stay includes a lower right stay 601 which is arranged on the lower side of the apparatus and an upper right stay 602 which is arranged on the upper side of the apparatus.

The lower left stay 501 and the upper left stay 502 are respectively provided between the front side plate 201 and the rear side plate 202 to maintain the distance between both side plates to a predetermined value, and are fixed to the front side plate 201 and the rear side plate 202. Accordingly, the left side surface of the frame 1 is configured with four components of the left side surface of the rear side plate 202, the left side surface of the front side plate 201, and the lower left stay 501 and the upper left stay 502.

The lower right stay 601 and the upper right stay 602 are respectively provided between the front side plate 201 and the rear side plate 202 to maintain the distance between both side plates to a predetermined value, and are fixed to the front side plate 201 and the rear side plate 202. Accordingly, the right side surface of the frame 1 is configured with four components of the right side surface of the rear side plate 202, the right side surface of the front side plate 201, and the lower right stay 601 and the upper right stay 602.

That is, two sheets of the plate-shaped front side plate 201 and the plate-shaped rear side plate 202 facing each other are arranged to have a certain distance, and the four stays 501, 502, 601, and 602 are arranged near the upper and lower corner portions thereof on the left and right so that the frame 1 according to the present embodiment is formed in an approximately box shape. The frame 1 is formed by the basic configurations, and the frame 1 of the image forming apparatus 10 is configured by adding various auxiliary frame members in order to store and reinforce the respective units, as necessary.

A left supporting leg 102 which is one first installation portion (grounding portion) that is in contact with the installation surface of the apparatus is provided on the lower surface of the lower left stay 501. The left supporting leg 102 is provided at a position closer to any one of the front side plate 201 and the rear side plate 202 than the center of the lower left stay 501 in the arrangement direction. According to the present embodiment, as described below, in a state in which a load is applied to the image forming apparatus for some reason, and the center of gravity is not moved, a center of gravity G (FIG. 4 described below) is positioned on the rear surface side from the center of the apparatus. Therefore, the left supporting leg 102 is provided at a position close to the rear side plate 202, i.e. a position closer to the second skeleton frame 202 than the center of the third skeleton frame 500. Also, it is preferable that the left supporting leg 102 is arranged at a position at which a perpendicular line is dropped from the center of gravity G to the lower left stay 501 (a position at which the center of gravity G is projected onto the lower left stay 501), or a nearby position thereof as shown in the present invention.

The right rear supporting leg 100 and the right front supporting leg 101 which are second and third grounding portions (two installation portions) coming into contact with the installation surface of the apparatus are provided on the lower surface of the lower right stay 601. The right front supporting leg 101, i.e., the third installation portion, is provided on the right stay 600 at a position distant from the right rear supporting leg 100, i.e., the second installation portion, about a distance equal to or greater than the half length of the lower right stay 601 in the arrangement direction, and the right rear supporting leg 100 and the right front supporting leg 101 are respectively arranged near both ends of the lower right stay 601 in the present embodiment. Preferably, the right rear supporting leg 100 is arranged at a lower position of the rear side plate 202 in the vertical direction or a nearby position thereof, and the right front supporting leg 101 is arranged at a lower position of the front side plate 201 in the vertical direction or a nearby position thereof. As described above, the recording medium conveyance portion 12 is arranged on one side (the right side seen from the front surface of the apparatus) of the main body of the apparatus in the substantially vertical direction. That is, the recording medium conveyance portion 12 is arranged at a position closer to the right stay 600 side than the center of the frame 1. Therefore, the frame 1 on a side on which the recording medium conveyance portion 12 is supported is supported at two points of the right rear supporting leg 100 and the right front supporting leg 101.

According to the present embodiment, so-called three point supporting in which the image forming apparatus 10 is supported with respect to the installation surface in three portions of the left supporting leg 102, the right rear supporting leg 100, and the right front supporting leg 101 is performed. Further, if a line is projected from the left supporting leg 102 to the right stay 600, the left supporting leg 102 is arranged between the right rear supporting leg 100 and the right front supporting leg 101. In addition, according to the present embodiment, the installation portions of the left supporting leg 102, the right rear supporting leg 100, and the right front supporting leg 101 each come into contact with the installation surface at one point. Further, the one point may have a certain extent of areas appropriate for supporting the load of the apparatus. In short, the installation portions and the installation surface may not be in point contact, but may be in the surface contact of so-called three point supporting.

Here, as illustrated in FIG. 3, the frame 1 supports an electric unit 400 in which electric components for driving the image forming portion 11 (FIG. 1) that forms images as described above are arranged. According to the present embodiment, the electric unit 400 is mounted on the rear side plate 202 that configures the frame 1. The electric unit 400 is configured with electric components such as controller units 401 and 402, a power supply 403, a drive unit 404, and the like. The controller units 401 and 402 include various kinds of electric equipments that control the image forming apparatus 10 (for example, a CPU, a memory, or the like). The power supply 403 supplies power to various units of the image forming apparatus 10. The drive unit 404 includes motors that become drive sources of various units in the image forming portion 11 and the recording medium conveyance portion 12.

Figure 4A:
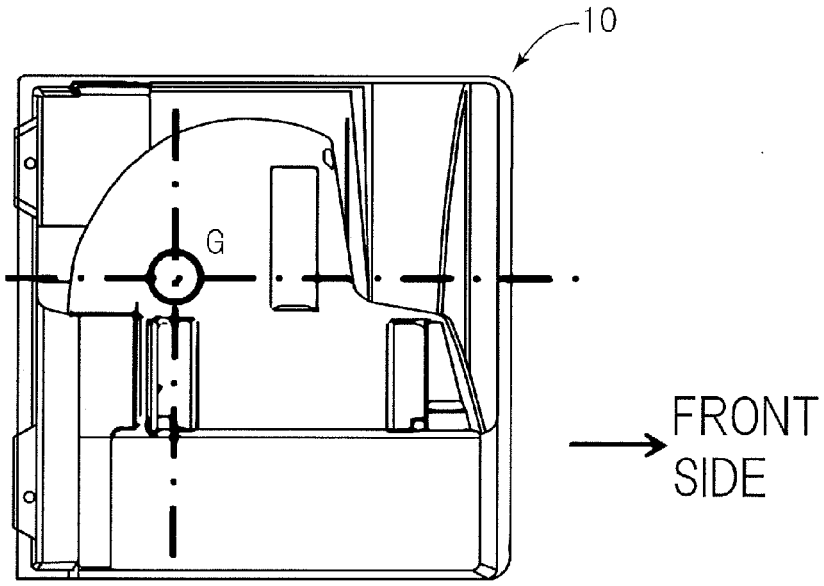
FIG. 4A is a plan view illustrating the image forming apparatus including the frame according to the first embodiment.

The electric unit 400 has weight since the electric unit 400 is configured by extensively using sheet metal or the like in various units and also motors are also arranged in the electric unit 400. Therefore, the electric unit 400 is heavier than various units mounted in the frame 1, that is, between the rear side plate 202 and the front side plate 201. Meanwhile, in consideration of the operability of the user, interfaces for exchanging periodically exchanged components such as the toner bottles 21 described above are provided on the front surface side of the apparatus so as to be opening and closing covers or releasing spaces for exchanging processes. Specifically, as shown in FIG. 5, the front side plate 201 which forms of the front side of the image forming apparatus has an opening portion 2011 in a lower end portion thereof through which the cassette 20 storing the recording medium passes when the cassette is extracted. Also, the front side plate 201 has an opening portion 2012 for accessing to the photoconductive drums 14 on an upper part of the opening portion 2011 and an opening 2013 for accessing to the toner bottles 21 on an upper part of the opening portion 2012 for accessing to the photoconductive drums 14. Accordingly, as illustrated in FIG. 4, the center of gravity G of the apparatus is at the position closer to the rear surface side than the center of the apparatus. According to the present embodiment, in consideration of the position of the center of gravity G, the position of the left supporting leg 102 is set as described above.

Figure 4B:
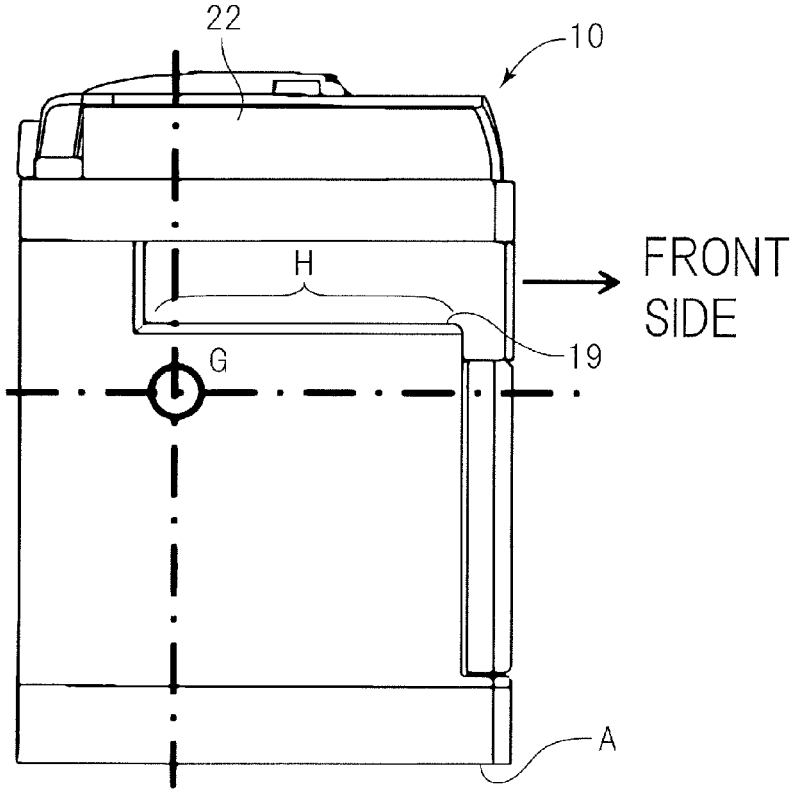
FIG. 4B is a side view illustrating the image forming apparatus of FIG. 4A.
Figure 5:
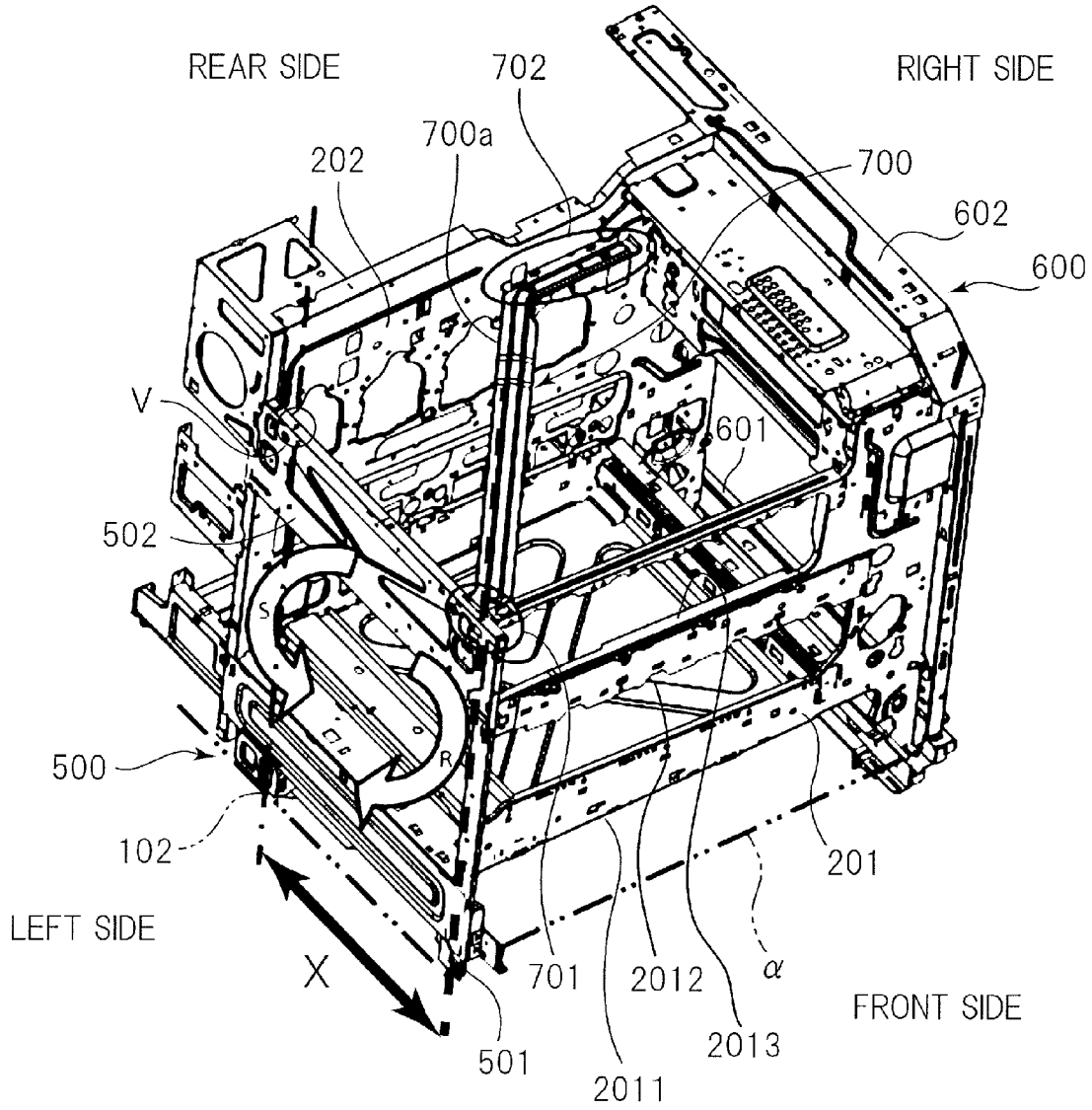
FIG. 5 is a perspective view illustrating the frame according to the first embodiment seen from above on the front surface side.

In addition, if a recording medium on which the toner images are fixed according to the image formation is loaded on the discharge tray 19, the position of the center of gravity of the recording media is on the almost central line of an area H illustrated in FIG. 4B. Therefore, the position of the center of gravity of the apparatus changes to the front surface side of the apparatus according to a loaded number of recording media on the discharge tray 19. In addition, as described above, since the user interface is provided on the front surface side of the apparatus, it may be assumed that a user carelessly puts his or her hand into the apparatus or applies force to the apparatus. Accordingly, in such cases, the position of the center of gravity of the apparatus changes to the front surface side of the apparatus.

In this manner, the center of gravity G of the image forming apparatus 10 is positioned at the position close to the rear surface of the apparatus, but the position of the center of gravity is not necessarily fixed. The position of the center of gravity changes and fluctuates according to the loading of the recording media or the user operation. Therefore, when the position of the left supporting leg 102 which is one of three supporting legs that support the frame 1 is arranged on the rear surface side, if the position of the center of gravity moves to the front surface side, it is likely that the frame 1 may be twisted.

That is, it is preferable that one installation portion provided on the side of the stay 500 is provided near the position in which the center of gravity of the apparatus is projected onto the stay 500 so that the load of the apparatus itself has less influence on the frame. However, in the image forming apparatus according to the present embodiment, the user interface that is not so heavy is arranged on the front surface side of the main body, and electric unit, drive unit, and the like that increase weight are arranged on the rear surface side. Therefore, the apparatus tends to be light on the front surface side of the apparatus, and to be heavy on the rear surface side.

Accordingly, the center of gravity of the apparatus is at a position closer to the rear surface than the center, and thus the one installation portion described above is provided at a position close to the rear surface side of the apparatus. In this manner, when the one installation portion is provided at the position close to the rear surface side of the apparatus, if great force is applied to the front surface side, the frame is easily twisted.

For example, since an operating panel accessed by the user and exchanging opening for toner bottles are provided on the upper portion of the front surface of the apparatus, it is likely that the load is applied by putting a hand on the front surface side of the apparatus by the user in order to operate the operating panel or exchange the toner bottles.

As a result, force greater than the load caused by the dead weight may be applied to the front surface side of the apparatus. In other words, it is likely that the position of the center of gravity of the apparatus may change according to the usage circumstances. Also, if the position of the center of gravity changes in this manner, there is a concern that the frame is twisted by the act of a moment on a stay provided with one installation portion, by using the one installation portion as the supporting point. In addition, if the cross-sectional area of the configuration member of the frame is increased in order to prevent the twist of the frame, the weight of the apparatus or the cost of the components increases.

Here, the problem caused when the frame of the image forming apparatus is twisted is described. In the full color image forming apparatus as described in the present embodiment, image position alignment of the respective colors (hereinafter, referred to as color shift correction) becomes an important factor for the image quality. Especially, according to the present embodiment, the image forming apparatus is of a so-called tandem type in which the toner images formed on the plurality of photoconductive drums 14 of which rotation shafts are in parallel are transferred onto the intermediate transfer belt 13 in an overlapped manner. Accordingly, the error of the color shift correction appears as the color shift amount in the recording image as it is.

In particular, one of the causes of the error of the color shift correction is the deformation such as the deflection or the twist of the frame due to the installation circumstance (levelness, unevenness, stiffness, or the like of the surface on which the image forming apparatus is installed) of the image forming apparatus. For example, if the image forming apparatus is installed on the installation surface having unevenness, the deformation such as the deflection or the twist occurs in the frame depending on the way of supporting the image forming apparatus. If the frame is deformed, the rotation shafts of the plurality of photoconductive drums 14 are twisted. As a result, the positions of the respective colors relatively change, and the change leads to the color shift of the recording image.

In addition, the deflection or the twist of the frame influences the stretching and the conveyance of the intermediate transfer belt 13 along the frame of the image forming apparatus by the rollers. That is, the twist of the frame destroys the alignment of the rollers that stretch the intermediate transfer belt 13, and accordingly the destroyed alignment leads to the increase of the approaching force of the intermediate transfer belt 13 in the axis direction of the rollers. That is, the force of moving the intermediate transfer belt 13 in the axis direction of the rollers increases. The increase of the approaching force of the intermediate transfer belt 13 causes the deterioration or the damage of the end portion of the belt and influences the life span of the intermediate transfer belt 13.

In addition, with respect to the recording medium conveyance portion 12 that conveys the recording medium from the cassette 20 to the image forming portion 11, it is likely that the twist or the like of the frame destroys the alignment of the respective conveying rollers or the like. If the alignment of the conveying rollers is destroyed, the recording medium may be easily conveyed in an inclined manner, so the conveying property decreases. Accordingly, in the image forming apparatus, the suppressing of the deflection or the twist of the frame becomes the main factor that influences the quality of manufactured goods.

Therefore, according to the present embodiment, the deformation of the frame 1 such as the twist caused by the installation circumstances of the apparatus is suppressed by setting the frame 1 to be in the so-called three point supporting. In addition, according to the present embodiment, the recording medium conveyance portion 12 is arranged at the position closer to the right stay 600 than the center of the frame 1, but the frame 1 on a side of supporting the recording medium conveyance portion 12 is supported at two points of a right rear supporting leg 100 and a right front supporting leg 101. According to the present embodiment, the frame 1 on a side of supporting the recording medium conveyance portion 12 is securely installed at two points so that the influence on the alignment of conveying rollers is suppressed.

However, according to the present embodiment, since the center of gravity G is at a position deviated to the rear surface side, the left supporting leg 102 is provided to be close to the rear surface of the apparatus that supports the left side surface of the frame 1. Meanwhile, since the right side surface of the frame 1 is supported by two of the right rear supporting leg 100 and the right front supporting leg 101, the right side surface of the frame 1 is stable against external force. Therefore, the left side surface of the frame 1 can be easily deformed to rotate in a direction indicated by an arrow R or an arrow S of FIG. 5 with respect to the right side surface. Especially, since the left supporting leg 102 is arranged to be close to the rear surface of the apparatus, the left side surface of the frame 1 is in a state of protruding to the front surface side of the apparatus from the left supporting leg 102. Therefore, the left side surface of the frame 1 is easily deformed on the front surface side by the external force. That is, if the position of the center of gravity of the apparatus is moved to the front surface side as described above, the frame 1 is easily twisted.

Therefore, according to the present embodiment, as illustrated in FIG. 5, the oblique stay 700 which is a coupling stay is provided in order to suppress the twist of the frame 1 caused by the movement of the position of the center of gravity. One end side of the oblique stay 700 is fixed to the left stay 500 at a position closer to one side plate (one skeleton frame) out of the front side plate 201 and the rear side plate 202 than the center of the left stay 500 in the arrangement direction. In addition, the other end side of the oblique stay 700 is fixed to the other side plate (the other skeleton frame) at a position closer to the right stay 600 than the left stay 500.

According to the present embodiment, the first end (one end side) of the oblique stay 700 is fixed to the upper left stay 502 near the coupling portion (corner portion) between the upper left stay 502 and the front side plate 201. That is, the left supporting leg 102 which is the installation portion on one side is arranged at a position close to the rear side plate 202, but a binding position 701 to the left stay 500 of the oblique stay 700 is at a position separated from the left supporting leg 102 and close to the front side plate 201. That is, as described above, the left side surface of the frame 1 is easily deformed (twisted) by external force on the front surface side. Accordingly, the binding position 701 of the oblique stay 700 to the left stay 500 is on the front side plate 201 side separated from the left supporting leg 102 in order to effectively suppress the twist caused by the external force on the front surface side. Especially, the twist suppressing effect can be obtained by causing a distance X from a perpendicular upper projection position V of the left supporting leg 102 to the binding position 701 to be as long as possible. Therefore, according to the present embodiment, the binding position 701 is provided near the coupling portion between the upper left stay 502 and the front side plate 201.

In addition, the second end (the other end side) of the oblique stay 700 is fixed to the rear side plate 202 near the coupling portion (corner portion) between the rear side plate 202 and the upper right stay 602. That is, a binding position 702 of the oblique stay 700 to the rear side plate 202 is at a position closer to the right stay 600 than the center of the rear side plate 202 between the left stay 500 and the right stay 600. In order to enhance the twist suppressing effect obtained by the oblique stay 700 against the external force on the front surface side, the other end side of the oblique stay 700 is separated from the left stay 500. Therefore, according to the present embodiment, the binding position 702 is positioned near the coupling portion between the rear side plate 202 and the upper right stay 602.

In addition, the oblique stay 700 is arranged approximately in parallel to a plane surface α including points at which the left supporting leg 102, the right rear supporting leg 100, and the right front supporting leg 101 are in contact with the installation surface of the apparatus. Since the plane surface α generally becomes horizontal in the installation state of the apparatus, the oblique stay 700 is arranged to be approximately in parallel to the level surface in the installation state of the apparatus. In addition, the oblique stay 700 is arranged near the upper end portion of the frame 1 in the vertical direction so as not to interfere with various apparatuses arranged in the frame 1.

Further, the oblique stay 700 includes a linear portion 700*a* obtained by forming a portion except the connection portion between the stays and the side plates to be linear. However, the portion may be curved or may have a stepped shape, in consideration of the interference with various apparatuses. In addition, the oblique stay 700 may not necessarily be in parallel to the plane surface α, or may be inclined to the plane surface α if the oblique stay 700 does not interfere with various apparatuses. However, in order to efficiently suppress the twist caused by the external force on the front surface side of the apparatus, it is preferable that the oblique stay 700 be arranged substantially parallel to the plane surface α. In addition, the oblique stay 700 may be arranged near the lower end portion of the frame 1 in the vertical direction, that is, between the lower left stay 501 and the rear side plate 202. However, in order to effectively suppress the twist of the frame 1, it is preferable that the oblique stay 700 be arranged near the upper end portion in the vertical direction which is separated from the installation surface. Further, the oblique stay 700 may be arranged near both of the upper end portion of the frame 1 in the vertical direction and the lower end portion of the frame 1 in the vertical direction.

Figure 6:
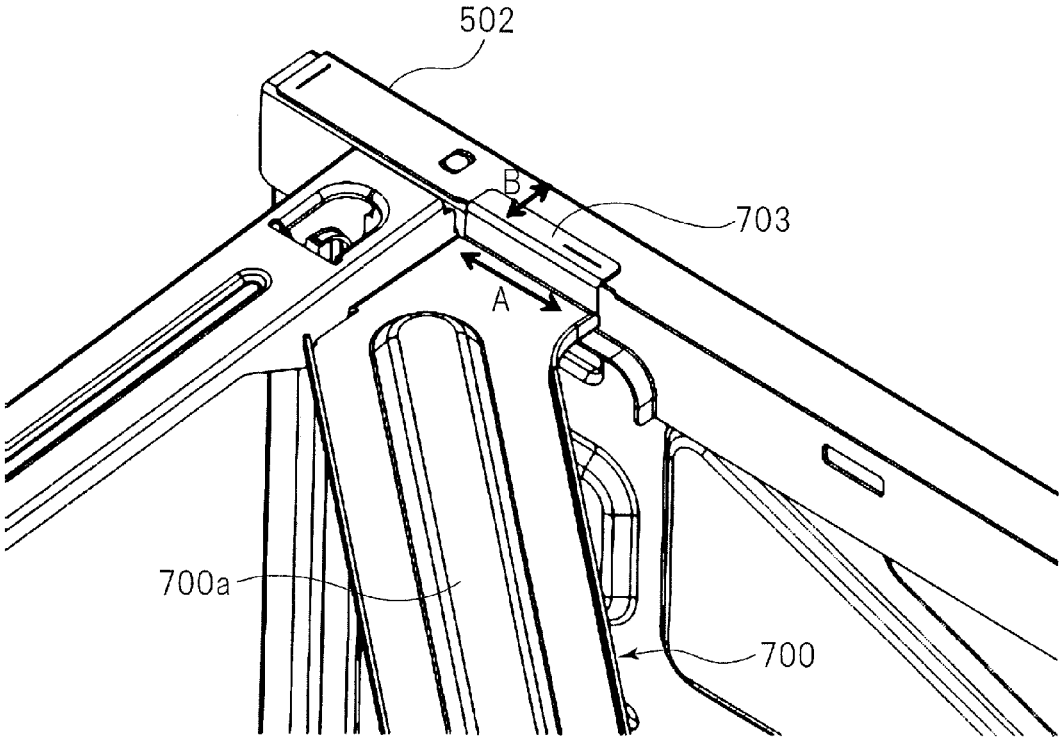
FIG. 6 is an enlarged perspective view illustrating a binding portion between an oblique stay and an upper left stay in the frame according to the first embodiment.
Figure 7:
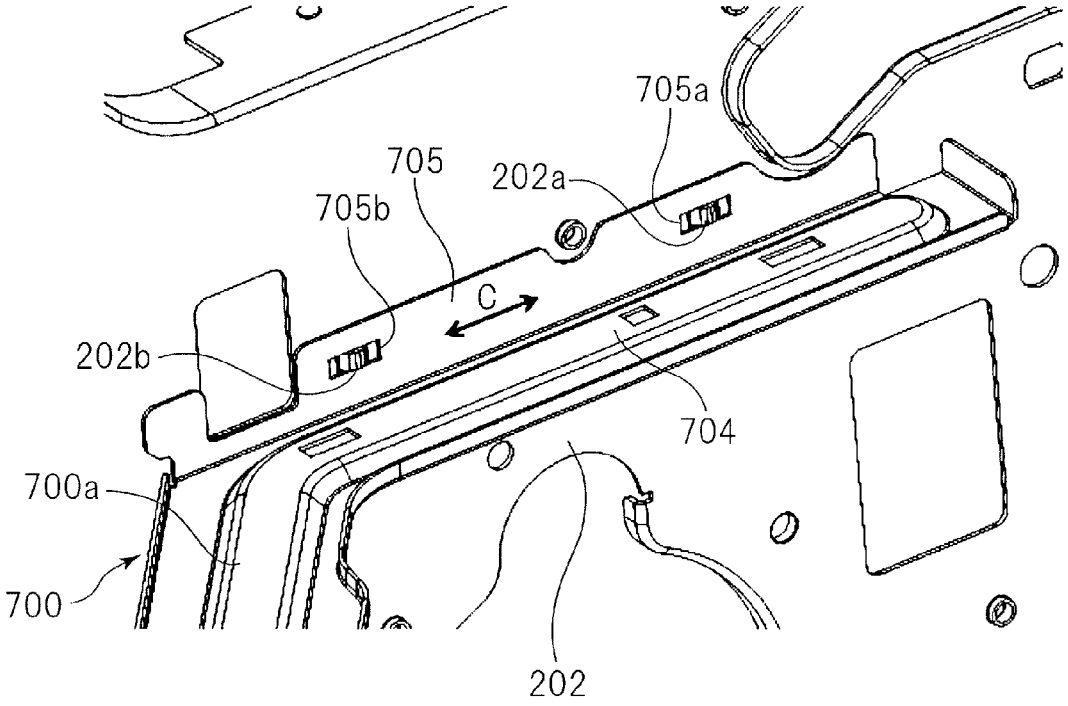
FIG. 7 is an enlarged perspective view illustrating a binding portion between the oblique stay and a rear side plate in the frame according to the first embodiment.

In addition, before the oblique stay 700 is fixed respectively to the upper left stay 502 and the rear side plate 202, the oblique stay 700 is movably connected respectively to the upper left stay 502 and the rear side plate 202 in arbitrary directions. Therefore, the binding portion between one end side of the oblique stay 700 and the upper left stay 502, and the binding portion between the other end side of the oblique stay 700 and the rear side plate 202 are respectively configured as illustrated in FIGS. 6 and 7. That is, as illustrated in FIG. 6, a hook portion 703 that is formed so as to hook the upper surface portion of the upper left stay 502 is provided on one end side of the oblique stay 700. When one end side of the oblique stay 700 is bound to the upper left stay 502, the position in the vertical direction is determined by hooking the hook portion 703 to the upper left stay 502. As a result, one end side of the oblique stay 700 is movably connected to the upper left stay 502 in an arrow A direction and an arrow B direction which are the arbitrary directions so as to be fixed at any position in the directions.

As illustrated in FIG. 7, the other end side of the oblique stay 700 has a bent portion 704 that is bent along the rear side plate 202 from the linear portion 700*a*, and a binding plate 705 is integrally formed in the bent portion 704. A plurality of engaging holes 705*a* and 705*b* are formed in the binding plate 705, and freely engaged with the plurality of engaging protrusions 202*a* and 202*b* formed to protrude to the rear side plate 202. The engaging holes 705*a* and 705*b* are formed to extend in an arrow C direction. Accordingly, in a state in which the engaging protrusions 202*a* and 202*b* are respectively engaged with the engaging holes 705*a* and 705*b*, the other end side of the oblique stay 700 is movably connected in the arrow C direction which is an arbitrary direction, so that the other end side of the oblique stay 700 can be fixed at any position in the direction.

According to the present embodiment, both end portions of the oblique stay 700 can be fixed to the upper left stay 502 and the rear side plate 202 at any position. That is, a positioning mechanism 703, 705, 202*a* and 202*b* which is capable of adjusting positions of the oblique stay 700 on the left stay (third skeleton frame) 500 and the rear side plate 202 (other skeleton frame) is composed of the hook portion 703, the binding plate 705 and the engaging protrusions 202*a* and 202*b*. Accordingly, even if relative positions between the upper left stay 502 and the rear side plate 202 are not constant, the oblique stay 700 can be fixed at appropriate positions by appropriately adjusting the positions. For example, the oblique stay 700 can be fixed after the twist of the frame is set to be in a desired state in advance by tools or the like. Therefore, the precision errors of the configuration components in the frame 1 are absorbed so that the high precision frame 1 with less twist can be obtained. Further, after positions of both end portions of the oblique stay 700 are determined respectively on the upper left stay 502 and the rear side plate 202, both end portions of the oblique stay 700 are fixed by the binding method such as welding or screw fastening.

According to the present embodiment configured in this manner, the oblique stay 700 is provided between the position closer to the front side plate 201 than the center of the left stay 500, provided with one leg of the left supporting leg 102 in the arrangement direction and the position close to the right stay 600 of the rear side plate 202. Therefore, even if the position of the center of gravity of the apparatus changes according to the usage circumstances, the left stay 500, provided with one leg of the left supporting leg 102, is rarely deformed, and the twist of the frame 1 or the like can be suppressed. In addition, since it is possible to suppress the twist of the frame 1 or the like merely by providing the oblique stay 700 in this manner, the cross-sectional area of the frame 1 does not need to be large, so the weight or the component cost can be prevented from increasing.

In addition, in the case of the present embodiment, since the support of the apparatus is set to be the so-called three point supporting, the state of the installation surface of the apparatus is rarely influenced. Accordingly, the deflection or the twist of the frame 1 can be suppressed by employing the configuration according to the present embodiment, regardless of the state of the installation surface of the image forming apparatus, or the change or the fluctuation of the center of gravity of the apparatus. Such an effect is remarkable according to the advancement of the downsizing of the apparatus and the weight reduction of the frame, so it is possible to provide an image forming apparatus appropriate for the downsizing and the low cost which is the recent demand of the market for the image forming apparatus according to the present embodiment. In addition, in the image forming apparatus 10 provided with the frame 1, the frame 1 is rarely twisted, so the color shift is suppressed, and the decrease in the life span of the intermediate transfer belt 13 is suppressed, and the conveying property of the recording medium is improved.

<Test>

Next, a test performed in order to check the effect of the present embodiment is described. First, a first test in which twist amounts of the frame are measured when the oblique stay 700 is provided and when the oblique stay 700 is not provided is described. In the test, in both cases, the position of the left supporting leg 102 is deviated to a position (Ref) of projecting the center of gravity G to the left stay 500. Then, at the respective positions, the twist amount of the frame only with the empty weight of the apparatus, and the twist amounts of the frame when a load of the 10 kg is applied to the left front side of the apparatus and when the load of 10 kg is applied to the left rear side of the apparatus are measured. Results thereof are presented in FIGS. 8A and 8B.

Figure 8A:
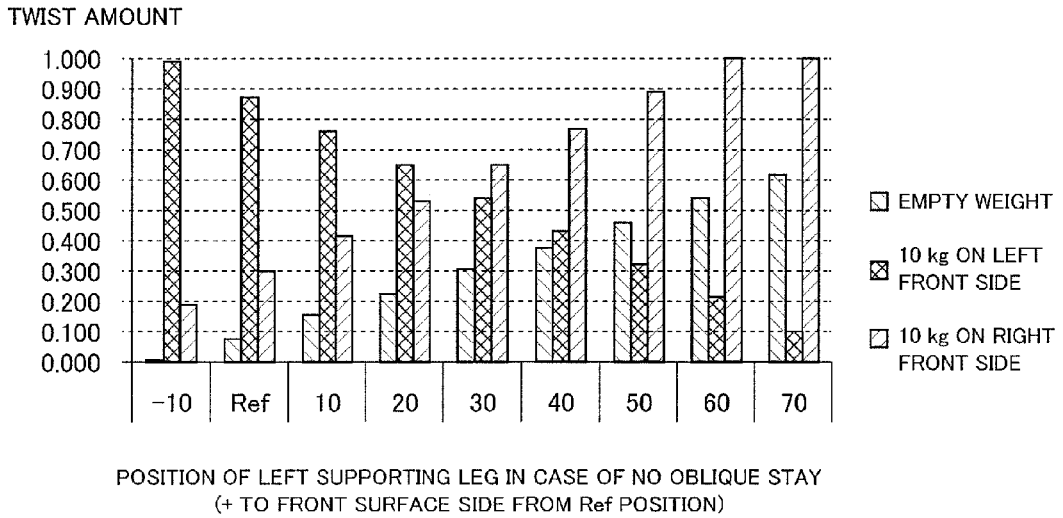
FIG. 8A is a graph indicating twist amounts of the frame when a position of a left supporting leg in Comparative Example in which an oblique stay is not provided in the frame is changed.
Figure 8B:
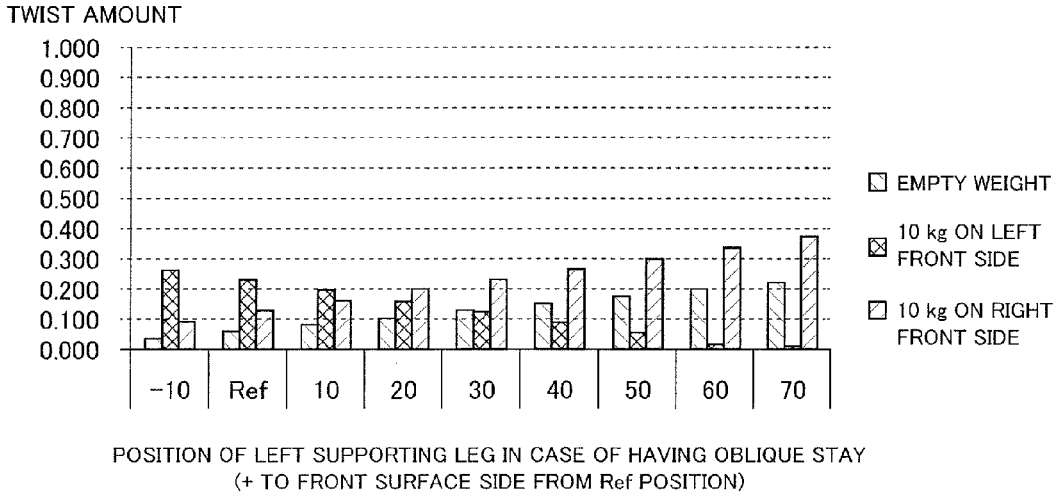
FIG. 8B is a graph indicating twist amounts of the frame when a position of a left supporting leg in an example in which an oblique stay is provided in the frame is changed.

FIG. 8A is a graph illustrating results when the oblique stay 700 is not provided, and FIG. 8B is a graph illustrating results when the oblique stay 700 is provided. In addition, out of three graphs with respect to the positions of the respective left supporting legs 102, the graph on the left indicates the case of the empty weight, the graph in the center indicates the case when the load of 10 kg is applied to the left front side, and the graph on the right indicates the case when the load of 10 kg is applied to the left rear side of the apparatus. As clearly indicated in FIGS. 8A and 8B, it is understood that the twist amount of the frame can be suppressed by providing the oblique stay 700. Especially, it is understood that the twist of the frame is drastically suppressed even if the load is applied to the left front side of the apparatus far from the left supporting leg 102.

Next, a second test in which the twist amounts of the frame when the arrangement direction and the length of the oblique stay 700 are changed are measured is described. In the test, as illustrated in FIGS. 9A to 9C, the twist amount of the frame only with the empty weight of the apparatus, and the twist amounts of the frame when the load of 10 kg is applied to the left front side of the apparatus and when the load of 10 kg is applied to the left rear side of the apparatus are measured by changing the arrangement direction and the length of the oblique stay 700.

Figure 9A:
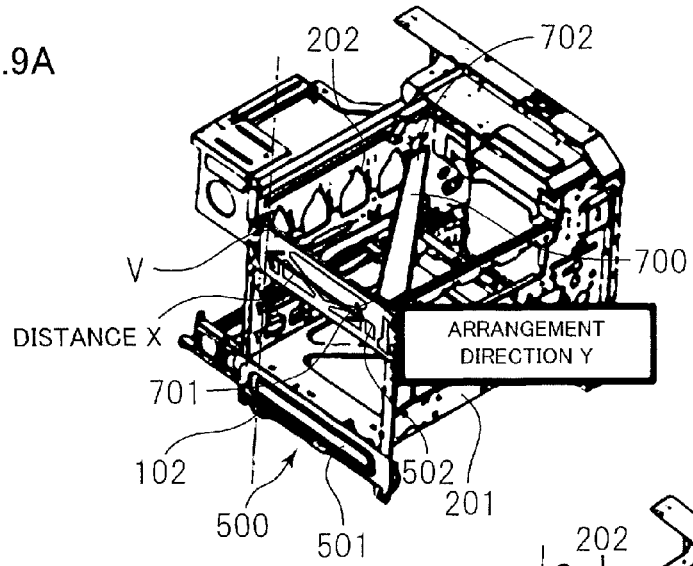
FIG. 9A is a perspective view of the frame according to a first example.

That is, in an "arrangement direction Y" of FIG. 9A, as described in the first embodiment described above, the arrangement direction of the oblique stay 700 is set to be in a direction from the front side plate 201 side of the upper left stay 502 to the right stay 600 side of the rear side plate 202. In addition, the binding position 701 between one end side of the oblique stay 700 and the upper left stay 502 is set to be on the front side plate 201 side from the left supporting leg 102. In addition, the distance X of the binding position 701 from the perpendicular upper projection position V of the left supporting leg 102 is set to be long. In addition, the binding position 702 between the other end side of the oblique stay 700 and the rear side plate 202 is on the right stay 600 side from the center between the left stay 500 and the right stay 600.

Figure 9B:
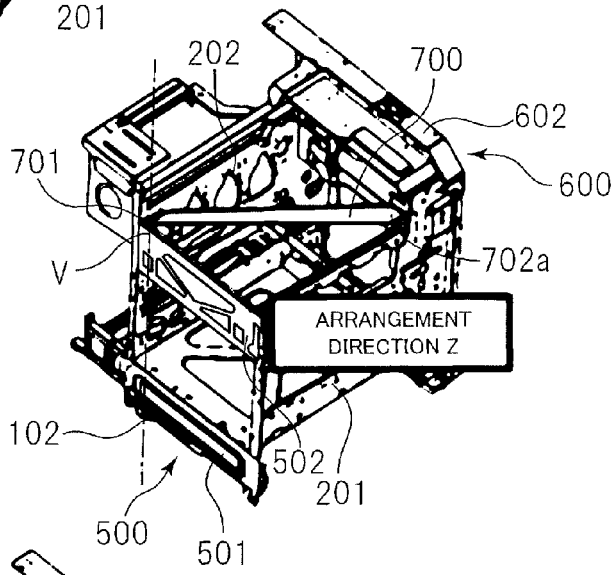
FIG. 9B is a perspective view of a frame according to a second example.

In an "arrangement direction Z" illustrated in FIG. 9B, the arrangement direction of the oblique stay 700 is set to be in a direction from the rear side plate 202 side of the upper left stay 502 to the right stay 600 side of the front side plate 201. In addition, the binding position 701 between one end side of the oblique stay 700 and the upper left stay 502 is on the rear side plate 202 side from the left supporting leg 102. In addition, a binding position 702 between the other end side of the oblique stay 700 and the front side plate 201 is on the right stay 600 side from the center between the left stay 500 and the right stay 600.

Figure 9C:
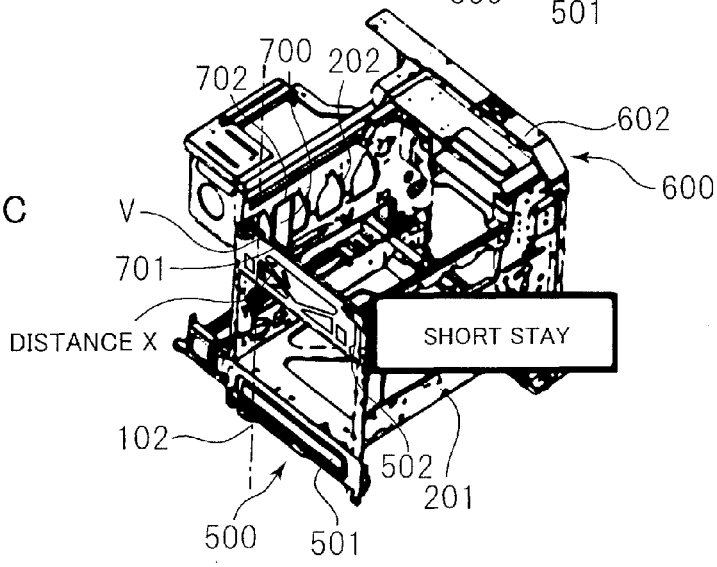
FIG. 9C is a perspective view of a frame when the oblique stay is caused to be short.

In a "short stay" illustrated in FIG. 9C, the arrangement direction of the oblique stay 700 is set to be in a direction from the front side plate 201 side of the upper left stay 502 to the left stay 500 side of the rear side plate 202. In addition, the binding position 701 between one end side of the oblique stay 700 and the upper left stay 502 is set to be on the front side plate 201 side from the left supporting leg 102. Further, the distance X of the binding position 701 from the perpendicular upper projection position V of the left supporting leg 102 is set to be short. In addition, the binding position 702 between the other end side of the oblique stay 700 and the rear side plate 202 is on the left stay 500 side from the center between the left stay 500 and the right stay 600. Then, the length of the oblique stay 700 is shorter than in the cases of FIGS. 9A and 9B.

Figure 10:
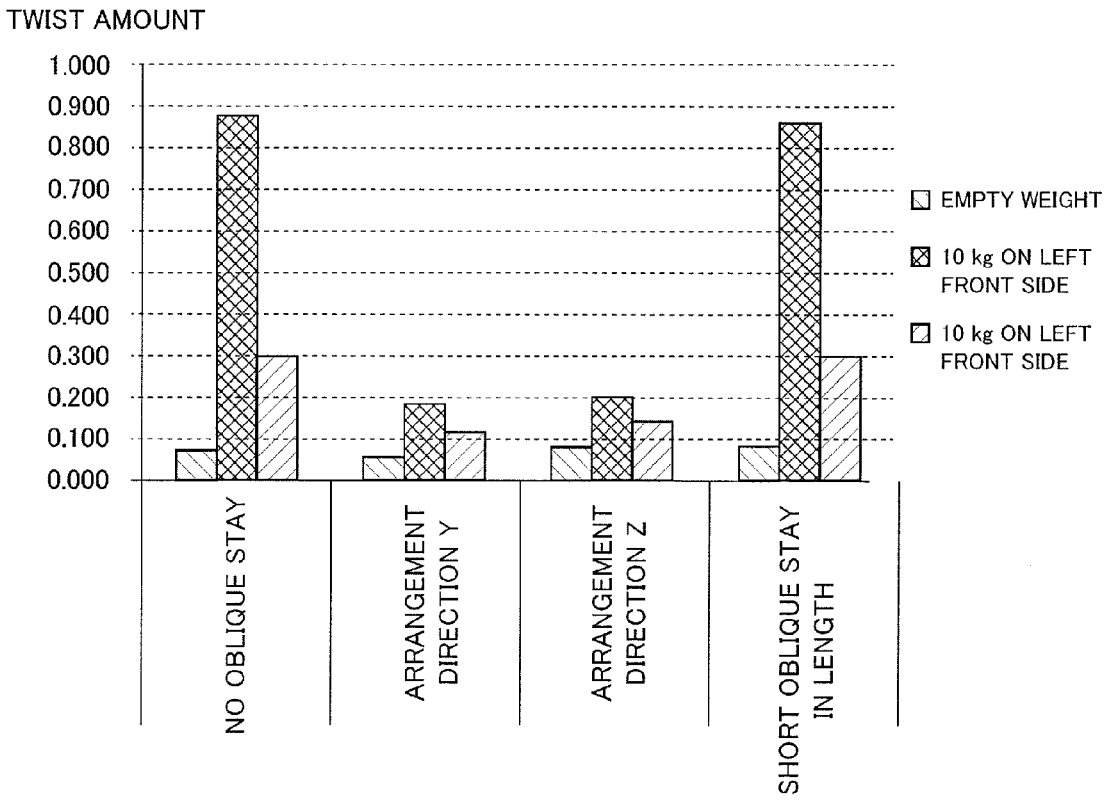
FIG. 10 is a graph indicating twist amounts of the respective frames in three cases of FIGS. 9A to 9C.

The results are presented in FIG. 10. In FIG. 10, a case in which the oblique stay 700 is not provided is also presented. Further, in all cases, the position of the left supporting leg 102 is at the position of projecting the center of gravity G to the left stay 500. In addition, out of three graphs in all the cases, the graph on the left indicates the case of the empty weight, the graph in the center indicates the case when the load of 10 kg is applied to the left front side, and the graph on the right indicates the case when the load of 10 kg is applied to the left rear side. As clearly indicated in FIG. 10, in the same manner as in FIGS. 9A and 9B, it is understood that when the oblique stay 700 is set to be long, the twist amount of the frame can be suppressed, compared with the case in which the oblique stay 700 is not provided and the case in which the oblique stay 700 is set to be short. Especially, it is understood that the twist of the frame is drastically suppressed even if the load is applied to the left front side of the apparatus far from the left supporting leg 102. Further, as illustrated in FIG. 9A, it is found that the twist amount of the frame can be suppressed by arranging the oblique stay 700.

Further, according to the first embodiment described above, the oblique stay 700 is arranged as illustrated in FIG. 9A, but as clearly indicated by the second test described above, the twist suppressing effect of the frame can be obtained if the oblique stay 700 is arranged as illustrated in FIG. 9B. That is, the one end side of the oblique stay 700 may be fixed to a position close to the rear side plate 202 of the left stay 500, and the other end side may be fixed to the front side plate 201. That is, one end side of the oblique stay 700 is fixed to the left stay 500 (first stay) at the position closer to one side plate (one skeleton frame) out of the front side plate 201 and the rear side plate 202 than the center of the left stay 500 in the arrangement direction. The other end side of the oblique stay 700 is fixed to the other side plate (the other skeleton frame) out of the front side plate 201 and the rear side plate 202 at a position closer to the right stay 600 (second stay) than the left stay 500. Accordingly, the length of the oblique stay 700 is secured, and the twist amount of the frame can be suppressed.

Second Embodiment

Figure 11:
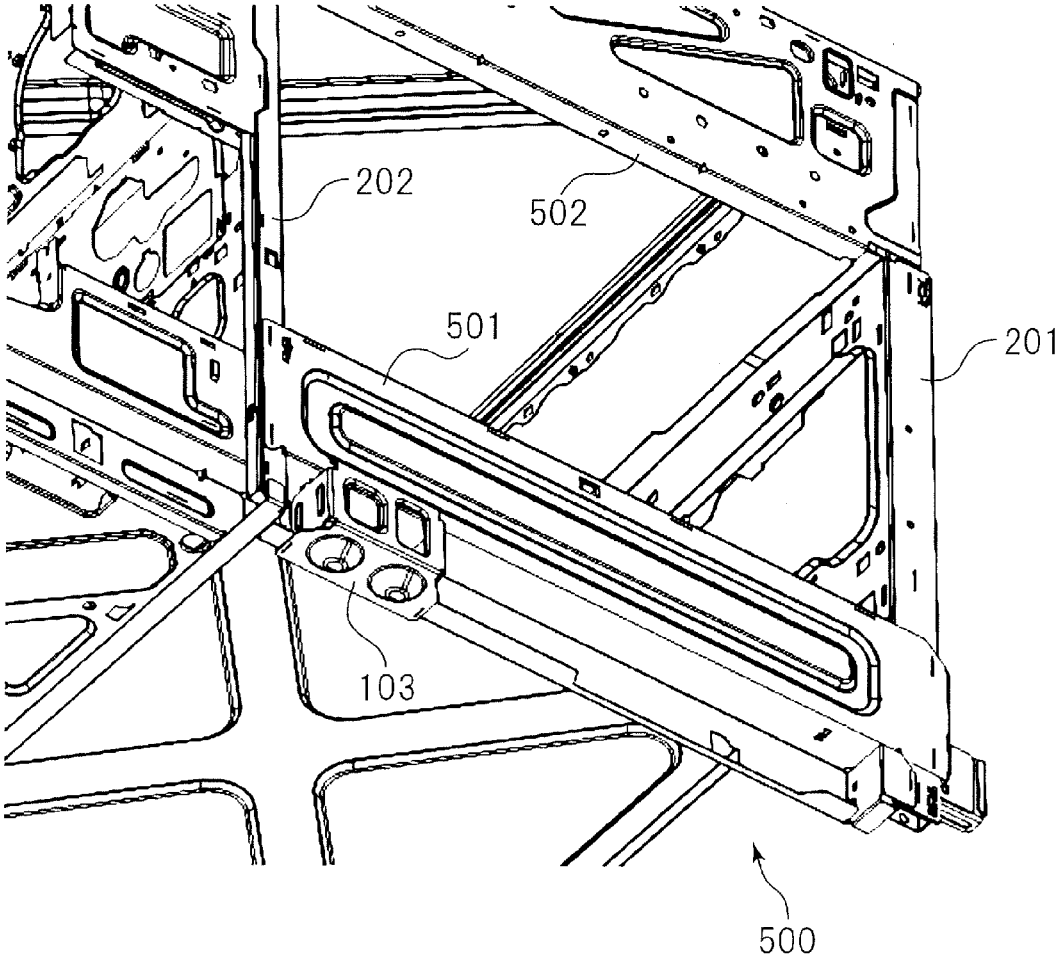
FIG. 11 is an enlarged perspective view illustrating a left supporting leg of a frame of an apparatus according to a second embodiment.

A second embodiment of the present invention is described with reference to FIG. 11. In the first embodiment described above, a configuration in which the left supporting leg 102 which is the first installation portion is in contact with the installation surface at one point is described. Meanwhile, according to the present embodiment, a left supporting leg 103 which is the first installation portion is in contact with the installation surface at two points. Since the other configurations and effects are the same as the first embodiment described above, the repeated drawings and descriptions are omitted, and the portions different from those in the first embodiment are mainly described.

The left supporting leg 103 is in contact with the installation surface at two points arranged in a distance shorter than a distance between the right rear supporting leg 100 and the right front supporting leg 101 (see FIGS. 2 and 3) which are second and third installation portions. That is, even if the left leg 103 contacts with the installation surface at two points, the left leg 103 is configured to substantially support the apparatus (frame 1) at three points with the right rear supporting leg 100 and the right front supporting leg 101. The two points are arranged in the arrangement direction of the left stay 500. Accordingly, it is possible to suppress the frame from being sensitively twisted in the same manner as a seesaw by using the supporting leg as the supporting point when being in contact with the installation surface at one point as in the first embodiment.

Further, if the distance between the two points is caused to become broader, it is possible to further suppress the frame from being sensitively twisted, but in this case, there is no difference from so-called four point supporting so that the frame is easily influenced by the flatness of the installation place. Accordingly, in order to continuously suppress the influence of the installation surface caused by the so-called three point supporting, it is preferable that the distance between the two points be equal to or lower than ⅓ of the length of a product provided with the left supporting leg 103, that is, the lower left stay 501, in the arrangement direction.

Other Embodiments

According to the respective embodiments described above, the configuration of the intermediate transfer scheme using the intermediate transfer belt as the image forming apparatus is described. However, the present invention can also be applied to the configuration of the direct transferring scheme in which toner images are directly transferred from photoconductive drums to a recording medium. In the case of the tandem-type configuration in the direct transferring scheme, while a recording medium is conveyed by a conveyor belt, toner images are transferred from respective photoconductive drums. Also in the configuration, since the twist of the frame influences the alignment of the rollers that stretch the conveyor belt, it is possible to suppress the decrease of the life span of the conveyor belt by applying the present invention.

Further, in addition to the full color configuration of the image forming apparatus, the present invention can be applied to various kinds of image forming apparatuses including an image forming apparatus having a configuration of outputting only monochrome images, an image forming apparatus having configurations other than the tandem type, and the like. Still further, the frame of the apparatus according to the present invention can be applied to apparatuses other than the image forming apparatus, and especially, the frame can be preferably applied to an apparatus in which the center of gravity changes when being used.

In addition, according to the respective embodiments described above, the left supporting leg is configured to be in contact with the installation surface at one point or two points, but the right rear supporting leg 100 and the right front supporting leg 101 may also be in contact with the installation surface at one point or two points in the same manner. Further, the points of the respective supporting legs which are in contact with the installation surface are not limited to one or two points, and may be a plurality of points such as three or four points as long as the influence of the installation surface by the so-called three point supporting can be continuously suppressed. It is noted, if the points of the respective supporting legs that are in contact with the installation surface are the same, the commonization of components is obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-182007, filed Sep. 3, 2013, which is hereby incorporated by reference herein in its entirety.

What is claimed is:

1. A frame of an apparatus comprising:

a first skeleton frame;

a second skeleton frame arranged to face the first skeleton frame;

a third skeleton frame configured to couple the first skeleton frame and the second skeleton frame on one end side;

a fourth skeleton frame configured to couple the first skeleton frame and the second skeleton frame on the other end side;

a first foot portion provided on the third skeleton frame at a position closer to the second skeleton frame side than a center portion of the third skeleton frame;

a second foot portion provided on the fourth skeleton frame;

a third foot portion provided on the fourth skeleton frame at a position having a distance equal to or greater than a half length of the fourth skeleton frame from the second foot portion and configured to perform substantially three point supporting on the frame together with the first and second foot portions; and a coupling stay configured to couple the third skeleton frame and at least one of the first and second skeleton frames, the coupling stay including:

a first end portion fixed to the third skeleton frame at a position closer to one skeleton frame of the first and second skeleton frames than the center of the third skeleton frame; and a second end portion fixed to the other skeleton frame of the first and second skeleton frames at a position closer to the fourth skeleton frame side than the third skeleton frame.

2. The frame of the apparatus according to claim 1, wherein the first end portion of the coupling stay is fixed to the third skeleton frame at a position closer to the first skeleton frame than the center of the third skeleton frame, and the second end portion is fixed to the second skeleton frame.

3. The frame of the apparatus according to claim 1, wherein the first end portion of the coupling stay is fixed to the third skeleton frame at a position closer to the second skeleton frame than the center of the third skeleton frame and the second end portion is fixed to the first skeleton frame.

4. The frame of the apparatus according to claim 1, wherein the first skeleton frame has an opening portion in a lower end portion.

5. The frame of the apparatus according to claim 4, wherein the second skeleton frame is formed to have higher stiffness than the first skeleton frame.

6. The frame of the apparatus according to claim 1, wherein the coupling stay is arranged approximately in parallel to a plane surface including points at which the first to third foot portions are in contact with an installation surface on which the apparatus is configured to be set.

7. The frame of the apparatus according to claim 1, wherein the third skeleton frame has a lower stay arranged on a lower side of the apparatus and an upper stay arranged on an upper side of the apparatus, wherein the first foot portion is arranged on the lower stay, and wherein the first end portion of the coupling stay is fixed to the upper stay.

8. The frame of the apparatus according to claim 1, wherein the first foot portion is in contact with an installation surface on which the apparatus is set at one point.

9. The frame of an apparatus according to claim 1, wherein the first foot portion is in contact with an installation surface on which the apparatus is set at two points arranged to have a shorter distance than a distance between the second foot portion and the third foot portion.

10. The frame of an apparatus according to claim 1, further comprising a positioning mechanism capable of adjusting positions of the coupling stay on the third skeleton frame and the other skeleton frame.

11. An image forming apparatus comprising:

a recording medium conveyance portion configured to convey a recording medium;

a frame according to claim 1 configured to support the recording medium conveyance portion; and an image forming portion configured to form an image on the recording medium conveyed by the recording medium conveyance portion.

12. The image forming apparatus according to claim 11, wherein the recording medium conveyance portion is arranged at a position closer to the fourth skeleton frame than a center of the frame.

13. The image forming apparatus according to claim 11, further comprising an electric unit in which an electric component for driving the image forming portion is arranged, wherein the electric unit is supported by the second skeleton frame.

14. The image forming apparatus according to claim 13, wherein the recording medium conveyance portion has a cassette that stores the recording medium to be conveyed, and wherein the first skeleton frame has an opening portion in a lower end portion thereof through which the cassette passes when the cassette is extracted.

15. An image forming apparatus comprising:

a main body including an image forming portion for forming an image on a recording material and a bottom of the main body, the bottom of the main body having a first side and a second side, the second side opposing the first side;

a supporting portion for supporting the main body substantially at three points, the supporting portion including:

a first foot portion which is proximate to the first side on one end side of the first side;

a second foot portion which is proximate to the first side on the other end side of the first side; and a third foot portion which is proximate to the second side on a same side with the second foot in a widthwise direction of the first side;

a first side frame provided with the main body on the same side with the first foot in the widthwise direction;

a second side frame provided with the main body, the second side frame opposing the first side frame;

a first stay configured to couple the first side frame and the second side frame;

a second stay configured to couple the first stay and the second side frame such that the second stay is fixed to the first stay on the same side with the first foot in the widthwise direction and the second stay is fixed to the second side frame at a position closer to the first side than the second side.

16. The image forming apparatus according to claim 15, wherein the second stay is arranged approximately in parallel to a plane surface including the first through third foot portions.

17. The image forming apparatus according to claim 15, wherein the first stay includes a lower stay arranged on a lower side of the main body, and an upper stay arranged on an upper side of the main body, and the third foot portion is provided with the lower stay and the second stay is fixed to the upper stay.

18. The image forming apparatus according to claim 15, further comprising a recording medium conveyance portion configured to convey a recording medium, the recording medium conveyance portion provided on the first side of the main body.

19. The image forming apparatus according to claim 15, further comprising an electric unit in which an electric component for driving the image forming portion is arranged, wherein the electric unit is supported by the second side frame.

20. The image forming apparatus according to claim 15, wherein the second stay is fixed to both of the first stay and first side frame.

21. The image forming apparatus according to claim 15, wherein the second stay includes a first extending portion extending from the first stay toward the second side frame, and a second extending portion extending along the second side frame.

22. An image forming apparatus comprising:

a main body including an image forming portion for forming an image on a recording material and a bottom of the main body, the bottom of the main body having a first side and a second side, the second side opposing the first side;

a supporting portion for supporting the main body substantially at three points, the supporting portion including:

a first foot portion which is proximate to the first side on one end side of the first side;

a second foot portion which is proximate to the first side on the other end side of the first side; and a third foot portion which is proximate to the second side on a same side with the second foot in a widthwise direction of the first side;

a first side frame provided with the main body on a same side with the first foot in the widthwise direction;

a second side frame provided with the main body, the second side frame opposing the first side frame;

a first stay configured to couple the first side frame and the second side frame;

a second stay configured to couple the first stay and the first side frame such that the second stay is fixed to the first stay on the opposite side of the first foot in the widthwise direction and the second stay is fixed to the first side frame at a position closer to the first side than the second side.

23. The image forming apparatus according to claim 22, wherein the second stay is arranged approximately in parallel to a plane surface including the first through third foot portions.

24. The image forming apparatus according to claim 22, wherein the first stay includes a lower stay arranged on a lower side of the main body, and an upper stay arranged on an upper side of the main body, and the third foot portion is provided with the lower stay and the second stay is fixed to the upper stay.

25. The image forming apparatus according to claim 22, further comprising a recording medium conveyance portion configured to convey a recording medium, the recording medium conveyance portion provided on the first side of the main body.

26. The image forming apparatus according to claim 22, further comprising an electric unit in which an electric component for driving the image forming portion is arranged, wherein the electric unit is supported by the second side frame.

* * * * *